US008015705B2

(12) United States Patent
Wilson, Jr. et al.

(10) Patent No.: US 8,015,705 B2
(45) Date of Patent: Sep. 13, 2011

(54) SPAR AND SHELL BLADE WITH SEGMENTED SHELL

(75) Inventors: Jack W Wilson, Jr., Palm Beach Gardens, FL (US); Wesley D Brown, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 12/843,935

(22) Filed: Jul. 27, 2010

(65) Prior Publication Data

US 2010/0290917 A1 Nov. 18, 2010

Related U.S. Application Data

(60) Continuation of application No. 12/355,353, filed on Jan. 16, 2009, which is a division of application No. 11/243,308, filed on Oct. 4, 2005, now Pat. No. 7,670,116, which is a continuation of application No. 10/793,641, filed on Mar. 4, 2004, now Pat. No. 7,080,971.

(60) Provisional application No. 60/454,095, filed on Mar. 12, 2003.

(51) Int. Cl.
*F01D 5/18* (2006.01)

(52) U.S. Cl. ..... 29/889.721; 29/889.72; 29/889.3; 416/226; 416/225

(58) Field of Classification Search ..... 29/889.721, 29/889.7, 889.72, 889.3, 889.722, 889.71; 416/226, 225, 223 A
See application file for complete search history.

(56) References Cited

U.S. PATENT DOCUMENTS

| | | | | |
|---|---|---|---|---|
| 4,023,249 | A | 5/1977 | Darrow et al. | |
| 4,285,634 | A | 8/1981 | Rossman et al. | |
| 4,311,433 | A | 1/1982 | Bratton et al. | |
| 4,314,794 | A * | 2/1982 | Holden et al. | 416/97 A |
| 4,321,010 | A | 3/1982 | Wilkinson et al. | |
| 4,376,004 | A | 3/1983 | Bratton et al. | |
| 4,473,336 | A | 9/1984 | Coney et al. | |
| 4,480,956 | A | 11/1984 | Kruger et al. | |
| 4,519,745 | A | 5/1985 | Rosman et al. | |
| 4,645,421 | A | 2/1987 | Huether | |
| 4,790,721 | A | 12/1988 | Morris et al. | |
| 5,083,371 | A * | 1/1992 | Leibfried et al. | 29/889.72 |
| 5,640,767 | A * | 6/1997 | Jackson et al. | 29/889.721 |
| 6,322,322 | B1 * | 11/2001 | Rhodes et al. | 415/191 |
| 2004/0126237 | A1 | 7/2004 | Jackson et al. | |
| 2005/0169762 | A1 | 8/2005 | Blume | |

* cited by examiner

*Primary Examiner* — David Bryant
*Assistant Examiner* — Christopher Besler
(74) *Attorney, Agent, or Firm* — John Ryznic

(57) ABSTRACT

A turbine rotor blade with a spar and shell construction, where the shell has an airfoil shape and is formed of two shell segments with an upper shell half and a lower shell half. The upper shell half is radially supported by a tip of the spar while the lower shell half is radially loaded by an attachment so that its load is not carried by the upper shell half and the tip of the spar in order to reduce overall stress levels.

3 Claims, 5 Drawing Sheets

SPAR AND SHELL BLADE WITH SEGMENTED SHELL

CROSS-REFERENCE TO RELATED APPLICATIONS

This application is a Continuation of U.S. Regular Utility application Ser. No. 12/355,353 filed Jan. 6, 2009 and entitled PROCESS FOR FORMING A SHELL OF A TURBINE AIRFOIL; which is a Divisional Application of U.S. Regular Utility application Ser. No. 11/243,308 filed on Oct. 4, 2005 and entitled TURBINE VANE WITH SPAR AND SHELL CONSTRUCTION; which claims the benefit to U.S. Regular utility application Ser. No. 10/793,641 filed on Mar. 4, 2004 and entitled COOLED TURBINE SPAR SHELL BLADE CONSTRUCTION by Jack Wilson, Jr. and Wesley Brown; which claims benefit to a Provisional application Ser. No. 60/454,095, filed on Mar. 12, 2003, entitled COOLED TURBINE BLADE by Jack Wilson, Jr. and Wesley Brown.

STATEMENT REGARDING FEDERALLY SPONSORED RESEARCH OR DEVELOPMENT

None.

BACKGROUND OF THE INVENTION

1. Field of the Invention

This invention relates to internally cooled turbine vanes for gas turbine engines and more particularly to the construction of the internally cooled turbine vane comprising a spar and shell construction.

2. Description of the Related Art Including Information Disclosed Under 37 Cfr 1.97 and 1.98

As one skilled in the gas turbine technology recognizes, the efficiency of the engine is enhanced by operating the turbine at a higher temperature and by increasing the turbine's pressure ratio. Another feature that contributes to the efficiency of the engine is the ability to cool the turbine with a lesser amount of cooling air. The problem that prevents the turbine from being operated at a higher temperature is the limitation of the structural integrity of the turbine component parts that are jeopardized in its high temperature, hostile environment. Scientists and engineers have attempted to combat the structural integrity problem by utilizing internal cooling and selecting high temperature resistant materials. The problem associated with internal cooling is twofold. One, the cooling air that is utilized for the cooling comes from the compressor that has already extended energy to pressurize the air and the spent air in the turbine cooling process in essence is a deficit in engine efficiency. The second problem is that the cooling is through cooling passages and holes that are in the turbine blade or vane which, obviously, adversely affects the blade or vane's structural prowess. Because of the tortuous path (a serpentine path through the blade or vane) that is presented to the cooling air, the pressure drop that is a consequence thereof requires higher supply pressure and more air flow to perform the cooling that would otherwise take a lesser amount of air given the path becomes friendlier to the cooling air. While there are materials that are available and can operate at a higher temperature that is heretofore been used, the problem is how to harness these materials so that they can be used efficaciously in the turbine environment.

To better appreciate these problems it would be worthy of note to recognize that traditional blade cooling approaches include the use of cast nickel based alloys with load-bearing walls that are cooled with radial flow channels and re-supply holes in conjunction with film discharge cooling holes. Examples of these types of blades and vanes are exemplified by the following patents that are incorporated herein by reference.

U.S. Pat. No. 3,378,228 issued to Davies et al on Apr. 16, 1968 shows a blade for a fluid flow duct and comprises ceramic laminations which may be in two or more parts, where the laminations are held together in compression by a hollow tie bar through which cooling air may be passed, and where the blades are mounted between platform members.

U.S. Pat. No. 4,790,721 issued to Morris et al on Dec. 13, 1988 shows an airfoil blade assembly having a metallic core, thin coolant liner and ceramic blade jacket including variable size cooling passages and a circumferential stagnant air gap to provide a substantially cooler core temperature during high temperature operations.

U.S. Pat. No. 4,473,336 issued to Coney et al on Sep. 25, 1984 shows a turbine blade with a spar formed with a central passageway with cooling holes passing through the spar wall into a cavity formed between an airfoil shaped shell and the spar.

U.S. Pat. No. 4,519,745 issued to Rosman et al on May 28, 1985 shows a ceramic blade assembly including a corrugated-metal partition situated in the space between the ceramic blade element and the post member, which corrugated-metal partition forms a compliant layer for the relief of mechanical stresses in the ceramic blade element during aerodynamic and thermal loading of the blade and which partition also serves as a means for defining contiguous sets of juxtaposed passages situated between the ceramic blade element and the post member, one set being open-ended and adjacent to exterior surfaces of the post member for directing cooling fluid there over and the second set being adjacent to the interior surfaces of the ceramic blade element and being closed-off for creating stagnant columns of fluid to thereby insulate the ceramic blade element from the cooling air.

U.S. Pat. No. 4,512,719 issued to Rossmann on Mar. 24, 1981 shows a turbine blade adapted for use with hot gases comprising a radially inward portion of metal including a core projecting radially outwards on which is supported a ceramic portion of airfoil section enclosing the core. The inner end of the ceramic portion forms a continuous surface contour with the metal inward portion. The ceramic portion extends no more than one-half of the total span of the blade and, preferably, about one-third of the blade span. In a particular embodiment, the wall thickness of the ceramic portion can increase in a radially outwards direction.

U.S. Pat. No. 4,563,128 issued to Rossmann on Jan. 7, 1986 shows a hot gas impinged turbine blade suitable for use under super-heated gas operating conditions has a hollow ceramic blade member and an inner metal support core extending substantially radially through the hollow blade member and having a radially outer widened support head. The support head has radially inner surfaces against which the ceramic blade member supports itself in a radial direction on both sides of the head. The radially inner surfaces of the head are inclined at an angle to the turbine axis so as to form a wedge or key forming a dovetail type connection with respectively inclined surfaces of the ceramic blade member. This dovetail type connection causes a compressive stress on the ceramic blade member during operation, whereby an optimal stress distribution is achieved in the ceramic blade member.

U.S. Pat. No. 4,247,259 issued to Saboe et al on Jan. 27, 1981 shows a composite, ceramic/metallic fabricated blade unit for an axial flow rotor includes an elongated metallic support member having an airfoil-shaped strut, one end of which is connected to a dovetail root for attachment to the rotor disc, while the opposite end thereof includes an end cap of generally airfoil-shape. The circumferential undercut extending between the end cap and the blade root is clad with an airfoil-shaped ceramic member such that the cross-section of the ceramic member substantially corresponds to the airfoil-shaped cross-section of the end cap, whereby the resulting composite ceramic/metallic blade has a smooth, exterior airfoil surface. The metallic support member has a longitudinally extending opening through which coolant is passed during the fabrication of the blade. Simultaneously, ceramic material is applied and bonded to the outer surface of the elongated airfoil-shaped strut portion, with the internal cooling of the metallic strut during the processing operation allowing the metal to withstand the processing temperature of the ceramic material.

U.S. Pat. No. 3,694,104 issued to Erwin on Sep. 26, 1972 shows a turbomachinery blade secured to a rotor disc by a pin.

U.S. Pat. No. 4,314,794 issued to Holden, deceased et al on Feb. 9, 1982 shows a transpiration cooled blade for a gas turbine engine is assembled from a plurality of individual airfoil-shaped hollow ceramic washers stacked upon a ceramic platform which in turn is seated on a metal root portion. The airfoil portion so formed is enclosed by a metal cap covering the outermost washer. A metal tie tube is welded to the cap and extends radially inwardly through the hollow airfoil portion and through aligned apertures in the platform and root portion to terminate in a threaded end disposed in a cavity within the root portion housing a tension nut for engagement thereby. The tie tube is hollow and provides flow communication for a coolant fluid directed through the root portion and into the hollow airfoil through apertures in the tube. The ceramic washers are made porous to the coolant fluid to cool the blade via transpiration cooling.

U.S. Pat. No. 3,644,060 issued to Bryan on Feb. 22, 1972 shows a cooled airfoil in which a shell is secured over a spar by dove-tail grooves.

U.S. Pat. No. 4,257,737 issued to Andress et al on Apr. 23, 1985 shows a Cooled Rotor Blade, where the cooled rotor blade is constructed having a cooling passage extending from the root and through the airfoil shaped section in a serpentine fashion, making several passes between the bottom and top thereof; a plurality of openings connect said cooling passage to the trailing edge; a plurality of compartments are formed lengthwise behind the leading edge of the blade; said compartments having openings extending through to the exterior forward portion of the blade; and sized openings connect the cooling passage to each of the compartments to control the pressure in each compartment.

U.S. Pat. No. 4,753,575 issued to Levengood et al on Jun. 28, 1988 shows an airfoil with nested cooling channels, where the hollow, cooled airfoil has a pair of nested, coolant channels therein which carry separate coolant flows back and forth across the span of the airfoil in adjacent parallel paths. The coolant in both channels flows from a rearward to forward location within the airfoil allowing the coolant to be ejected from the airfoil near the leading edge through film coolant holes.

U.S. Pat. No. 5,476,364 issued to Kildea on Dec. 19, 1995 shows a tip seal and anti-contamination for turbine blades, where a cavity is judiciously dimensioned and located adjacent the tip's surface discharge port of internally cooling passage of the airfoil of the turbine blade of a gas turbine engine and extending from the pressure surface to the back wall of the discharge port guards against the contamination and plugging of the discharge port.

U.S. Pat. No. 5,700,131 issued to Hall et al on Dec. 23, 1997 shows an internally cooled turbine blade for a gas turbine engine that is modified at the leading and trailing edges to include a dynamic cool air flowing radial passageway with an inlet at the root and a discharge at the tip feeding a plurality of radially spaced film cooling holes in the airfoil surface. Replenishment holes communicating with the serpentine passages radially spaced in the inner wall of the radial passage replenish the cooling air lost to the film cooling holes. The discharge orifice is sized to match the backflow margin to achieve a constant film hole coverage throughout the radial length. Trip strips may be employed to augment the pressure drop distribution.

Also well known by those skilled in this technology is that the engine's efficiency increases as the pressure ratio of the turbine increases and the weight of the turbine decreases. Needless to say, these parameters have limitations. Increasing the speed of the turbine also increases the airfoil loading and, of course, satisfactory operation of the turbine is to stay within given airfoil loadings. The airfoil loadings are governed by the cross sectional area of the turbine multiplied by the velocity of the tip of the turbine squared, or $AN^2$. Obviously, the rotational speed of the turbine has a significant impact on the loadings.

The spar/shell construction contemplated by this invention affords the turbine engine designer the option of reducing the amount of cooling air that is required in any given engine design. And in addition, allowing the designer to fabricate the shell from exotic high temperature materials that heretofore could not be cast or forged to define the surface profile of the airfoil section. In other words, by virtue of this invention, the shell can be made from Niobium or Molybdenum or their alloys, where the shape is formed by a well known electric discharge process (EDM) or wire EDM process. In addition, because of the efficacious cooling scheme of this invention, the shell portion could be made from ceramics, or more conventional materials and still present an advantage to the designer because a lesser amount of cooling air would be required.

BRIEF SUMMARY OF THE INVENTION

An object of this invention is to provide a guide vane for a gas turbine engine that is constructed with a spar and shell configuration.

A feature of this invention is an inner spar that extends from a root of the vane to the tip, and is secured to the attachment at the root by a pin or rod member.

Another feature of this invention is that the shell and/or spar can be constructed from a high temperature material such as ceramics, Molybdenum or Niobium (Columbium) or a lesser temperature resistive material such as Inco 718, Waspaloy or well known single crystal materials currently being used in gas turbine engines. For existing types of engine designs where it is desirable of providing efficacious turbine vane cooling with the use of compressed air at lower amounts and obtaining the same degree of cooling, and for advanced engine designs where it is desirable to utilize more exotic materials such as Niobium or Molybdenum, the shell and spar can be made out of these materials or the spar can be made from a lesser exotic material with lower melting points that is more readily cast or forged.

Another feature of this invention for engine designs that require higher turbine rotational speeds, the spar can be made from a dual spar systems where the outer spar extends a shortened distance radially relative to the inner spar and defines at the junction a mid spar shroud, and the shell is formed in an upper section and a lower section where each section is joined at the mid span shroud. The pin in this arrangement couples the inner spar and outer spar at the attachment formed at the root of the vane. This design can utilize the same materials that are called out in the other design.

A feature of this invention is an improved turbine vane that is characterized as being easy to fabricate, provide efficacious cooling with lesser amounts of cooling air than prior art designs, provides a shell or shells that can be replaced and hence affords the user the option of repair or replacement. The materials selected can be conventional or more esoteric depending on the specification of the engine.

The forgoing and other features of the present invention will become more apparent from the following description and accompanying drawings.

DETAILED DESCRIPTION OF THE INVENTION

Figure 1:
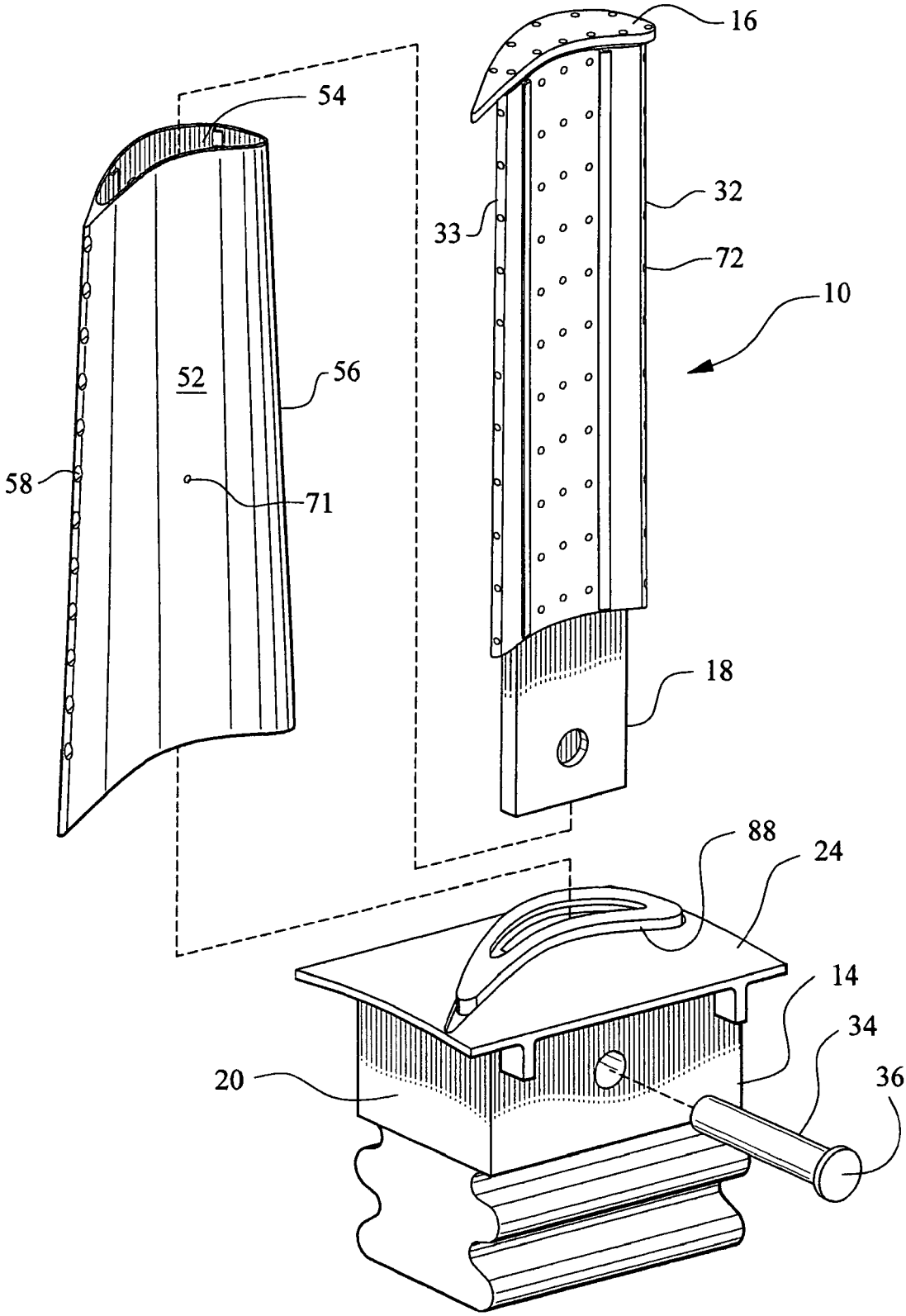
FIG. 1 is an exploded view in perspective showing the details of one embodiment of this invention.
Figure 2:
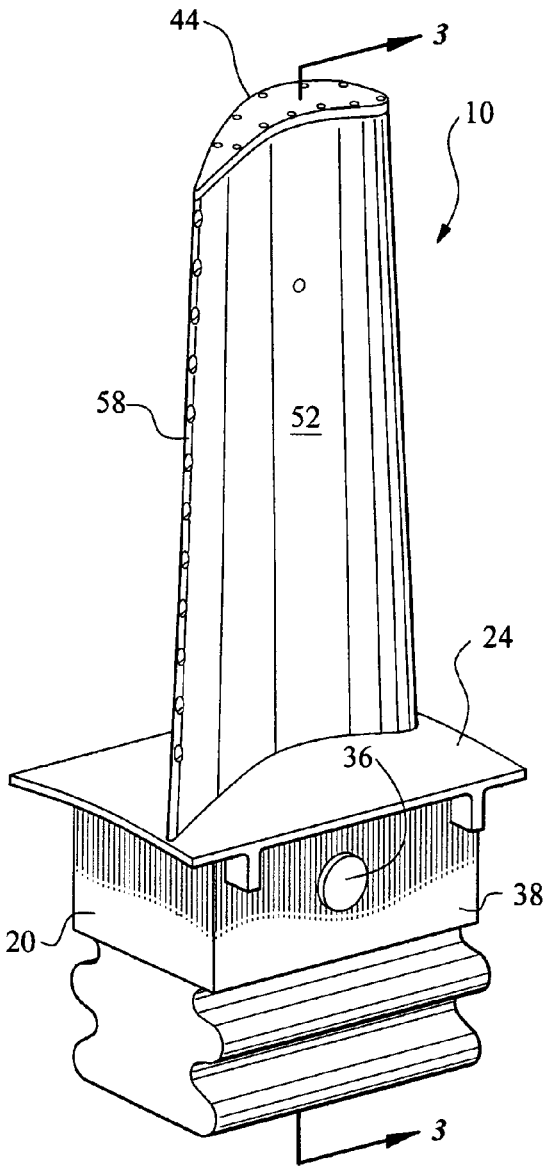
FIG. 2 is a perspective view illustrating the assembled turbine blade of the embodiment depicted in FIG. 1 of this invention.
Figure 3:
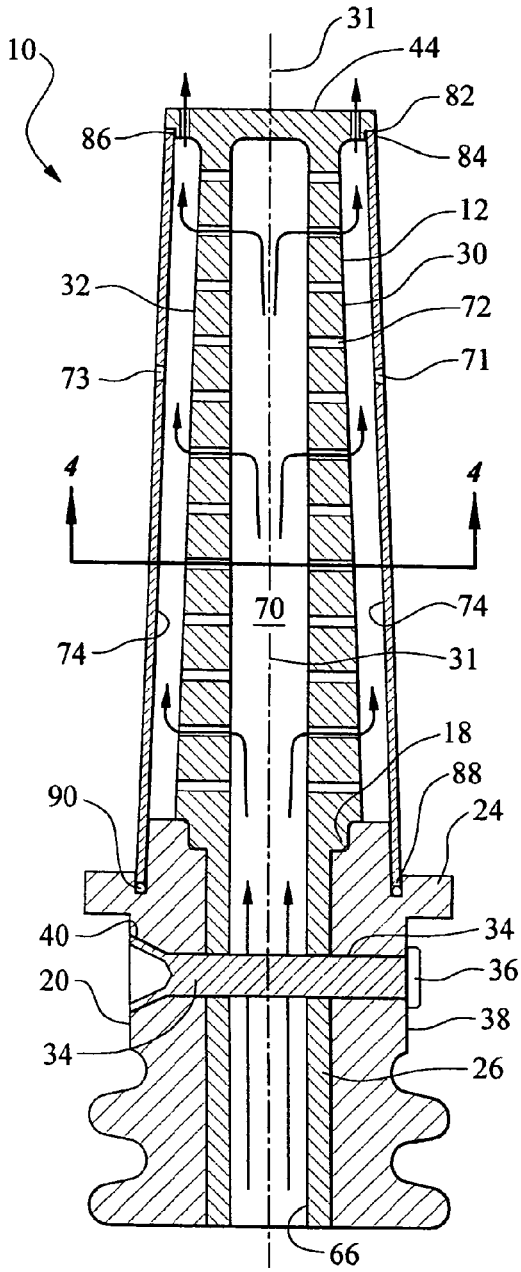
FIG. 3 is a section taken from sectional lines 3-3 of FIG. 2.
Figure 4:
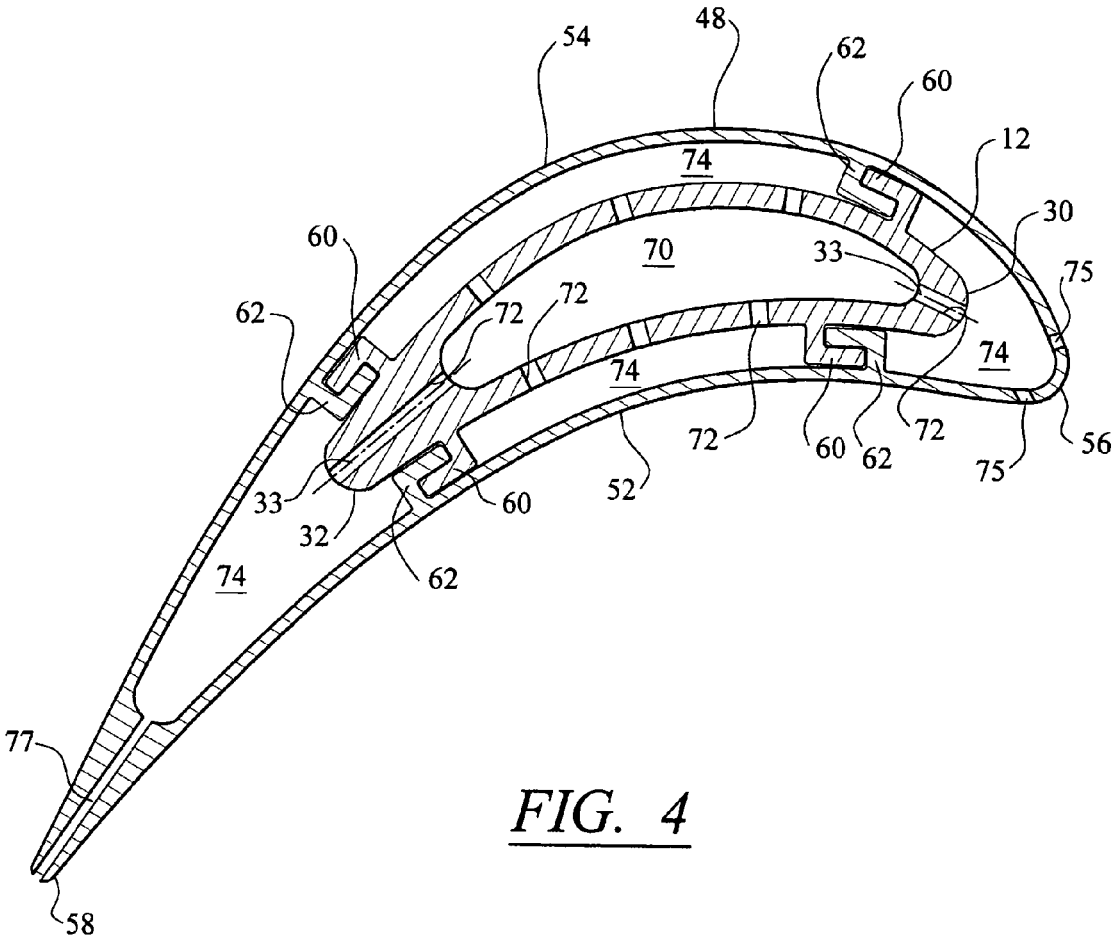
FIG. 4 is a section taken along the sectional lines 4-4 of FIG. 3 illustrating the attachment of the shell to the strut of this invention.

While this invention is described in its preferred embodiment in two different, but similar configurations so as to take advantage of engines that are designed at higher speeds than are heretofore encountered, this invention has the potential of utilizing conventional materials and improving the turbine rotor by enhancing its efficiency by providing the desired cooling with a lesser amount of compressed air, and affords the designer to utilize a more exotic material that has a higher resistance temperature while also maintaining the improved cooling aspects. Hence, it will be understood to one skilled in this technology, the material selected for the particular engine design is an option left open to the designer while still employing the concepts of this invention. For the sake of simplicity and convenience, only a single vane in each of the embodiments for the vane is described although one skilled in this art would know that the turbine rotor consists of a plurality of circumferentially spaced blades and vanes mounted in a rotor disk (blades) or attached to the casing (vanes) that makes up the rotor assembly.

This disclosure is divided into two embodiments employing the same concept of a spar and a shell configuration of a turbine blade, where one of the embodiments includes a single spar and the other embodiment includes a double spar to accommodate higher rotational speeds. FIGS. 1 through 4 are directed to one of the embodiments of the turbine blade generally illustrated as reference numeral 10 as comprising a generally elliptical shaped spar 12 extending longitudinally or in the radial direction from a root portion 14 to a tip 16 with a downwardly extending portion 18 that fairs into a rectangular shaped projection 26 that is adapted to fit into an attachment 20. The spar 12 spans the camber stations extending along the airfoil section defined by a shell 48. The attachment 20 may include a fir tree attachment portion 22 that fits into a complementary fir tree slot formed in the turbine disk (not shown). The attachment 20 may be formed with a platform 24 or the platform 24 may be formed separately and joined thereto and projects in a circumferential direction to abut against the platform 24 in the adjacent blade in the turbine disk. A seal, such as a feather seal (not shown) may be mounted between platforms of adjacent blades to minimize or eliminate leakage around the individual blades.

The spar 12 may be formed as a single unit or made up of complementary parts and, as for example, it may be formed in two separate portions that are joined at the parting plane along the leading edge facing portion 30 and trailing edge facing portion 32 and extending the longitudinal axis 31. Spar 12 is secured to the attachment 20 by an attachment pin 34 which fits through a hole 29 in the attachment 20 and an aligned hole 31 formed in the extension 18. Pin 34 carries a head 36 that abuts against a face 38 of the attachment 20 and includes a flared out portion 40 at an opposing end of the head 36. This arrangement secures the spar 12 and assures that the load on the blade 10 is transmitted from the airfoil section through the attachment 20 to the disk (not shown). The tip 16 of the blade 10 may be sealed by a cap 44 that may be formed integrally with the spar 12, or may be a separate piece that is suitably joined to the top end of the spar 12. it should be appreciated that this design can accommodate a squealer cap, if such is desired. The material of the spar 12 will be predicted on the usage of the blade and in a high temperature environment the material can be a molybdenum or niobium, and in a lesser temperature environment the material can be a stainless steel like Inco 718 or Waspaloy or the like.

Shell 48 extends over the surface of the spar 12 and is hollow in the central portion 50 and spaced from the outer surface of spar 12. The shell 48 defines a pressure side 52, a suction side 54, a leading edge 56, and a trailing edge 58. As mentioned in the above paragraph, the shell 48 may be made from different materials depending on the specification of the gas turbine engine. In the higher temperature requirements, the shell 48 preferably will be made from Molybdenum, Niobium, alloys of Molybdenum or Niobium (Columbium), Oxide Ceramic Matrix Composite (CMC), or SiC—SiC Ceramic Matrix Composite (CMC), and in lesser temperature environments the shell 48 may be made from conventional materials. If the material selected cannot be cast or forged into the proper airfoil shape, then the shell 48 will be made from a blank and the contour will be machined by a wire EDM process. The shell 48 can be made in a single unit or into two halves divided along the longitudinal axis, similar to the spar 12. As best seen in FIG. 1, the attachment 20 is made to include a stud portion 88 that complements the contoured surface of the spar 12 and the contoured surface of the shell 48. Additionally, the shell 48 and the spar 12 carry complementary male and female hooks 60 and 62. An upper edge 84 of the shell 48 is supported by the cap 44 and fits into an annular groove 82 so that the upper edge 84 bears against a shoulder 86. A lower edge 88 fits into an annular complementary groove 90 formed on the upper edge of a platform 24 and bears against the opposing surfaces of the groove 90 and the outer surface of the attachment 20.

As mentioned in the above paragraphs, one of the important features of this invention is that it affords efficacious cooling, i.e. cooling that requires a lesser amount of air. This can be readily seen by referring to FIG. 3. As shown, the cooling air is admitted through an inlet 66, the central opening formed in the spar 12 at a bottom face 68 of the attachment 20, and flows in a straight passage or cavity 70 without having to flow through tortuous paths like a serpentine path. Air that is admitted into cavity 70 flows out of feed holes 72 into a space or cavity 74 defined between the spar 12 and the shell 48. Again, there are virtually no tortuous passages that are typically found in prior art designs, and hence the pressure drop is decreased requiring lesser amounts of air at a lower pressure, all of which enhances the cooling efficiency of the blade. The air from the feed holes 72 that may be formed integrally in the spar 12 or drilled therein can serve to impinge on the inner wall of the shell 48 but primarily feeds the space 74. it should be understood that this design can include film cooling holes (as for example holes 71 and 73) formed in the shell 48 on both the pressure surface 52 and the suction surface 54, and may also include a shower head 77 on the trailing edge 58. the design and number of all these cooling holes (i.e., the shower head, the film cooling holes, feed holes) are predicted on the particular specification of the engine.

Figure 5:
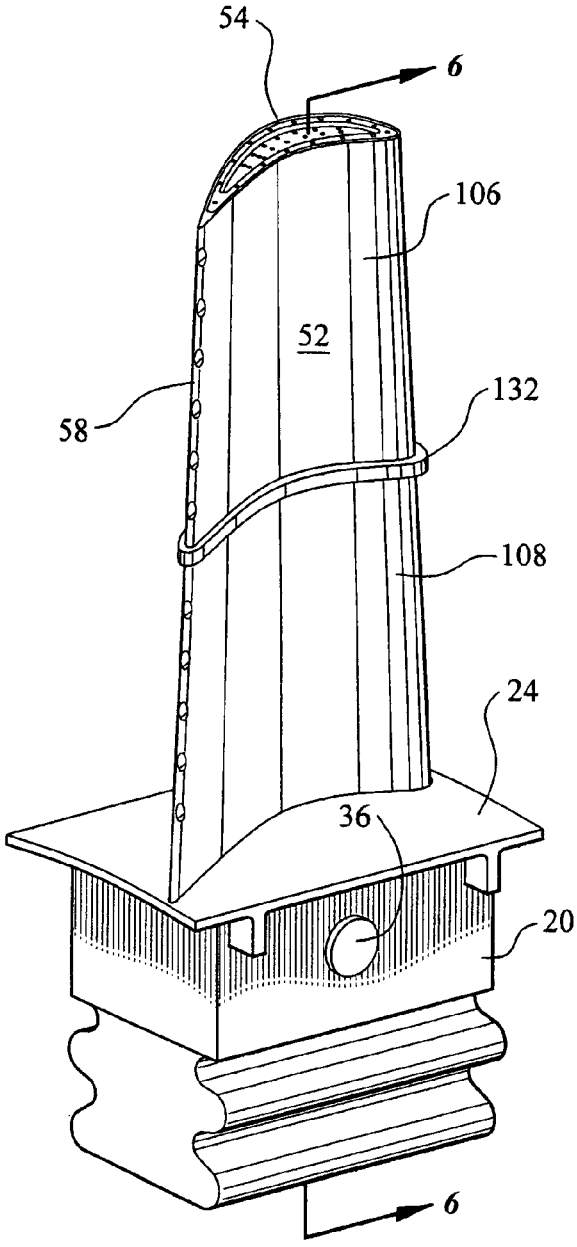
FIG. 5 is a perspective view illustrating a second embodiment of this invention.
Figure 6:
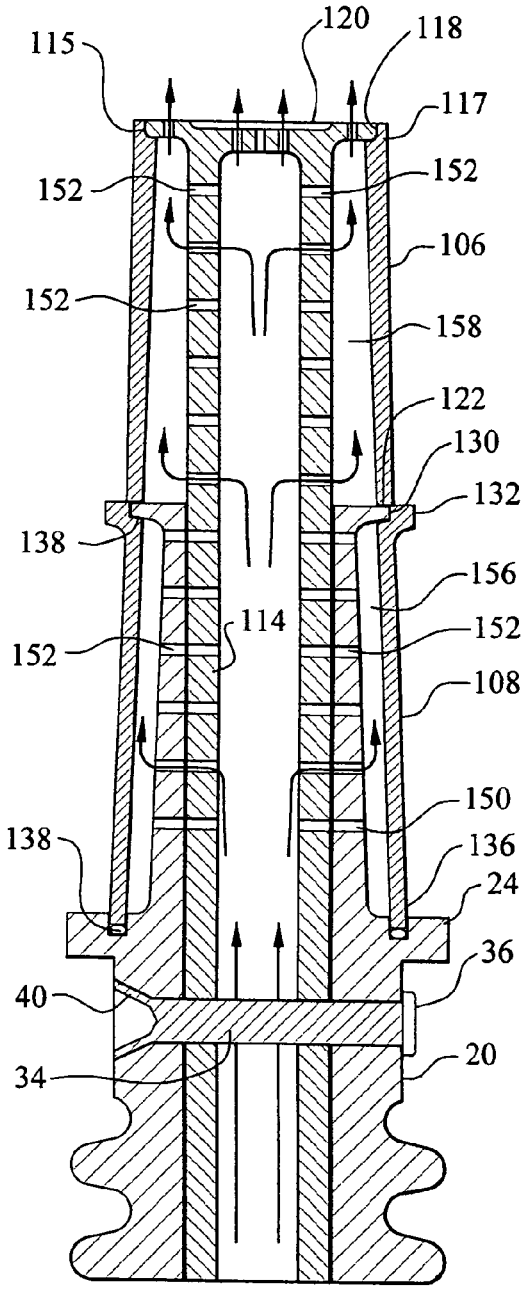
FIG. 6 is a section view in elevation taken along the sectional lines of 6-6 of FIG. 5.

Another embodiment is shown in FIGS. 5 and 6, and is similarly constructed and is adapted to handle a higher rotational speed of the turbine. In this embodiment, a shell 104 that is equivalent to the shell 48 in the first embodiment (FIGS. 1-4) is formed into two halves, an upper halve 106 and a lower halve 108, and an attachment 110 that is equivalent to the attachment 20 is extended in the longitudinal and upward direction to extend almost midway along the airfoil portion of the blade to form another spar 112. This spar 112 surrounds the lower portion 114 of spar 12 (like numerals in all figures depict like or similar elements) and is contiguous thereto along its inner surface. A ledge or platen 116 is formed integrally therewith at the top end and extends in the span wise direction. Shell upper halve 106 and shell lower halve 108 are formed in an elliptical-like shape to define the airfoil for defining the pressure surface 52, the suction surface 54, the leading edge 56, and the trailing edge 58. A groove 115 formed at an upper edge 117 of shell upper halve 106 bears against the outer edge 118 of cap 120 which is the equivalent of cap 16 of the FIGS. 1-4 embodiment except it is a squealer cap. Obviously, when the blade is rotating the shell upper halve 106 is loaded against the cap 120 and this force is transmitted to the disk via the spar 112 and spar 114. A lower edge 122 bears against the platen 116 and can be suitably attached thereto by a suitable braze or weld. The shell lower halve 108 is similarly formed like the shell upper halve 106 and defines the lower portion of the airfoil. The shell lower halve 108 includes a groove 130 formed in an increased diameter portion 132 of the shell lower halve 108 and serves to receive an outer edge 134 of the platen 116. A lower edge 136 of the shell lower halve 108 fits into an annular groove 138 formed in the platform 24. While not shown in these figures, the male and female hooks associated with the spar and shell is also utilized in this embodiment. The stud is like the first embodiment and is affixed to the attachment via a pin 34.

The cooling arrangement of the second embodiment of FIGS. 5 and 6 is almost identical to the cooling configuration of the first embodiment. the only difference is that since the platen 116 forms a barrier between the shell upper halve 106 and the shell lower halve 108, the cooling air to the lower portion of the airfoil is directed from the inlet 66 and passage 70 via radially spaced holes 150 consisting of the aligned holes in the spars 112 and 114 that feed space 156, and holes 152 formed in the upper portion of the spar 112 that feed a space 158. As is the case with the first embodiment, the shell may include a shower head at the leading edge, cooling passages at the trailing edge, holes at the tip for cooling and discharging dirt and foreign particles in the coolant, and film cooling holes at the surface of the pressure side and the suction side.

The above first and second embodiments of the present invention disclosed a rotary blade having the shell secured to a spar, the spar being secured to rotor disc. In the third, fourth, and fifth embodiments shown in FIGS. 7-9, the spar and shell construction for an airfoil is used in a stationary vane. The vane in FIG. 7 includes an outer shroud segment 220 and an inner shroud segment 230 with the vane extending between the two shroud segments, as is well known in the prior art. The outer shroud segment 220 includes hooks 224 to secure the outer shroud segment 220 to the casing. The outer shroud segment 220 includes an attachment portion 222 having an opening for a spar 212. Both the attachment portion 222 and the spar 212 include a hole 234 in which a pin or bolt would be mounted and secured as in the first and second embodiments. The spar 212 and the outer shroud segment 220 are formed as a single piece in this embodiment, and include grooves 290 in which the shell 248 would fit, as in the first two embodiments. A central passageway or cavity 270 supplies the cooling air to cooling holes 272 in the spar 212 and cooling holes 271 in the shell 248. The inner shroud segment 230 on the spar 212 also includes cooling holes 272. The principal for securing the shell between grooves in the outer shroud segment and inner shroud segment for the third embodiment is the same as in the first and second embodiments.

Figure 7:
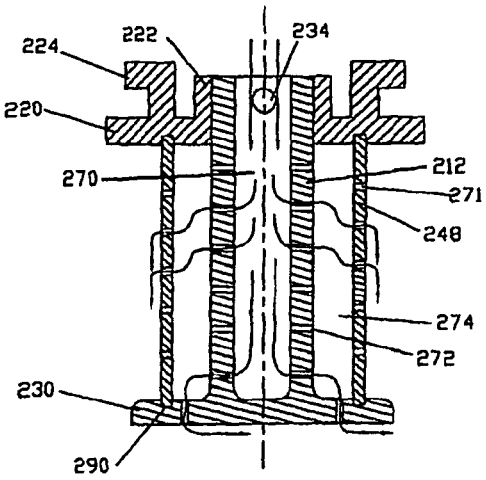
FIG. 7 is a section view of a third embodiment of this invention, showing a vane.
Figure 8:
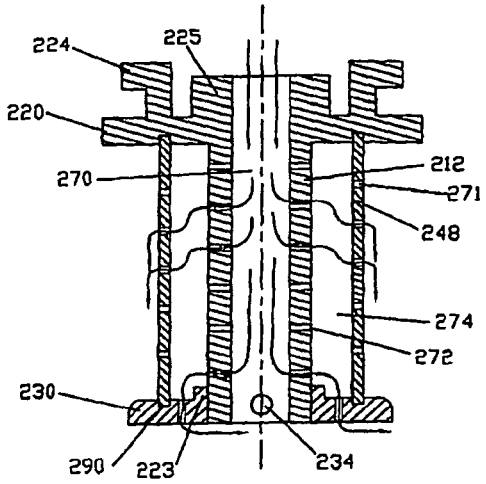
FIG. 8 is a sectional view of a fourth embodiment of this invention.

The fourth embodiment of the present invention is shown in FIG. 8 and is similar to the third embodiment in FIG. 7. In the fourth embodiment, the outer shroud 220 and the spar 212 are formed as a single piece, and the inner shroud segment 230 includes the attachment portion 223 having an opening in which the spar 212 passes through. Both the spar 212 and the inner shroud segment 230 includes holes 234 in which a pin or bolt is placed to secure the inner shroud segment 230 to the spar 212. The outer shroud segment 220 can include a raised portion 225 that formed the attachment portion 220 in the FIG. 7 embodiment in order to provide a strengthened portion on the outer shroud segment to support a load from the spar 212.

Figure 9:
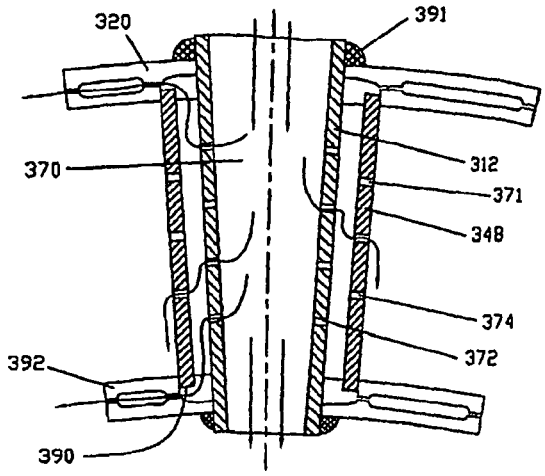
FIG. 9 is a section view of a fifth embodiment of this invention showing another vane.

FIG. 9 shows a variation of the vane of the third and fourth embodiments to form the fifth embodiment of the present invention. Here, the outer shroud segment 320 and the inner shroud segment 393 each include an opening in which the spar 312 extends through, and welds 391 to secure the spar 312 to the two shroud segments 320 and 392. The shell 348 is placed within grooves 390 between the shroud segments prior to welding. As in the previous four embodiments, the spar 312 and the shell 348 each includes cooling holes 372 and 374 for delivering cooling air from a central passageway or cavity 370 to cooling the airfoil. In the fifth embodiment of FIG. 9, the outer shroud can also include the hooks like those in FIGS. 7 and 8 to mount the shroud and vane assembly to the casing. The outer shroud can be made of the Molybdenum, while the shell can be made from Molybdenum, Niobium, Ceramic Matrix Composite, or Single Crystal materials. The joint between the inner shroud and the shell is a thermally free joint with a rope seal made from Nextel material.

Although this invention has been shown and described with respect to detailed embodiments thereof, it will be appreciated and understood by those skilled in the art that various changes in form and detail thereof may be made without departing from the spirit and scope of the claimed invention.

We claim the following:

1. A multiple piece turbine rotor blade comprising:

a spar extending from a blade attachment;

a shell having an airfoil shape with a leading edge and a trailing edge and a pressure side wall and a suction side wall;

the shell including an upper shell half and a lower shell half;

the upper shell half being radially loaded on a tip of the spar; and, the lower shell half being radially loaded on a lower edge of a tip of the blade attachment.

2. The multiple piece turbine rotor blade of claim 1, and further comprising:

the shell is made from Molybdenum or Niobium.

3. The multiple piece turbine rotor blade of claim 1, and further comprising:

the upper shell half and the lower shell half are both formed as a single piece.

* * * * *